US006772737B2

(12) United States Patent
Gaessler et al.

(10) Patent No.: US 6,772,737 B2
(45) Date of Patent: Aug. 10, 2004

(54) METHOD AND CIRCUIT SYSTEM FOR OPERATING A SOLENOID VALVE

(75) Inventors: Hermann Gaessler, Vaihingen (DE); Udo Diehl, Stuttgart (DE); Karsten Mischker, Leonberg (DE); Rainer Walter, Pleidelsheim (DE); Juergen Schiemann, Markgroeningen (DE); Christian Grosse, Kornwestheim (DE); Volker Beuche, Stuttgart (DE); Stefan Reimer, Markgroeningen (DE); Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 78 days.

(21) Appl. No.: 09/959,082

(22) PCT Filed: Jan. 25, 2001

(86) PCT No.: PCT/DE01/00279

§ 371 (c)(1),
(2), (4) Date: Jan. 15, 2002

(87) PCT Pub. No.: WO01/61156

PCT Pub. Date: Aug. 23, 2001

(65) Prior Publication Data

US 2002/0157650 A1 Oct. 31, 2002

(30) Foreign Application Priority Data

Feb. 16, 2000 (DE) ..... 100 06 849
Nov. 22, 2000 (DE) ..... 100 57 778

(51) Int. Cl.[7] ..... F01L 9/04; F02M 51/00

(52) U.S. Cl. ..... 123/490; 123/90.11; 251/129.18; 239/585.1

(58) Field of Search ..... 123/490, 90.11; 251/129.09, 129.15, 129.18, 129.2; 239/585.1; 361/152, 154

(56) References Cited

U.S. PATENT DOCUMENTS 3,758,260 A * 9/1973 Newport et al. ..... 431/78
4,150,654 A * 4/1979 Heitzman et al. ..... 123/179.16
4,297,742 A * 10/1981 Heitzman et al. ..... 361/154
4,453,652 A * 6/1984 Merkel et al. ..... 222/504
4,922,878 A * 5/1990 Shinogle et al. ..... 123/490
5,020,988 A * 6/1991 Peterson ..... 431/51
5,150,687 A * 9/1992 Paganon et al. ..... 123/490
5,435,717 A * 7/1995 Bohan et al. ..... 431/46
5,499,157 A * 3/1996 Younessi et al. ..... 361/191
5,622,148 A * 4/1997 Xue et al. ..... 123/179.25
5,765,513 A * 6/1998 Diehl et al. ..... 123/90.11
5,905,625 A * 5/1999 Schebitz ..... 361/154
5,924,435 A * 7/1999 Wall et al. ..... 137/1
5,975,057 A 11/1999 Sawyer et al. ..... 123/490
6,014,956 A * 1/2000 Cowden et al. ..... 123/446
6,119,659 A 9/2000 Wright ..... 123/490
6,390,082 B1 * 5/2002 Duffy et al. ..... 123/682
6,557,506 B2 * 5/2003 Sturman ..... 123/90.12
6,572,074 B2 * 6/2003 Yang et al. ..... 251/54
6,575,126 B2 * 6/2003 Sturman ..... 123/90.11
2003/0010325 A1 * 1/2003 Reischl et al. ..... 123/490

FOREIGN PATENT DOCUMENTS

DE 40 24 496 2/1992
FR 2 689 306 10/1993
JP 229937 * 8/1999 ..... F02D/41/20

* cited by examiner

*Primary Examiner*—Hai Huynh
(74) *Attorney, Agent, or Firm*—Kenyon & Kenyon

(57) ABSTRACT

In a method and a circuit system for operating a solenoid valve, particularly for actuating an electrohydraulic gas-exchange valve control, an injection valve, or an intake or exhaust valve of an internal combustion engine, to permit the simplest possible driving of the solenoid valve, the solenoid valve is acted upon in a controlled manner in a cycle including three phases, in which in a pull-up phase, the solenoid valve is connected for a predefined time duration to a first voltage of predetermined magnitude for generating a pull-up current, in a holding phase is connected to a second voltage of predetermined magnitude for generating a holding current, and in a de-energize phase is separated from both voltages.

19 Claims, 4 Drawing Sheets

METHOD AND CIRCUIT SYSTEM FOR OPERATING A SOLENOID VALVE

FIELD OF THE INVENTION

The present invention relates to a method and a circuit system for operating a solenoid valve, particularly for actuating an electrohydraulic gas-exchange valve control, an injection valve, or an intake or exhaust valve of an internal combustion engine.

BACKGROUND INFORMATION

The electrohydraulic gas-exchange valve control of an internal combustion engine for the camshaft-free actuation of the gas-exchange valves of the internal combustion engine is conventional. Each gas-exchange valve of an electrohydraulic gas-exchange valve control has a separate actuator for the opening and closing. The actuator has a control element which is subdivided in the interior by a hydraulic differential piston into a first chamber and a second chamber. A first solenoid valve is arranged on the intake side of the first chamber, and a second solenoid valve is arranged on the outlet side of the first chamber. Three phases are differentiated in response to the actuation of the electrohydraulic gas-exchange valve control:

In a first phase, the second solenoid valve is initially closed. Directly after that, the first solenoid valve is opened. Oil can flow with a high pressure from the supply side via the first solenoid valve into the first chamber of the control element. The closed second solenoid valve prevents the oil from flowing out of the first chamber toward a tank. A comparable pressure prevails in the first chamber as in the second chamber. The side of the differential piston facing the first chamber has a substantially larger effective area than the side facing the second chamber. A resulting force causes an opening movement of the gas-exchange valve.

In a second phase, the gas-exchange valve is held statically open at full stroke or partial stroke. To that end, the first solenoid valve is closed, so that both solenoid valves are closed for the inlet or outlet of oil.

In a third phase, the second solenoid valve is opened while the first solenoid valve continues to be closed, so that the oil which has flowed into the first chamber can flow off again. The pressure in the first chamber diminishes very sharply compared to the pressure in the second chamber, resulting in a closing movement of the gas-exchange valve.

It is also conventional to provide a plurality of intake and exhaust valves per cylinder of an internal combustion engine. For example, when working with 4-valve technology, each cylinder has two intake valves and two exhaust valves for the gas exchange. Therefore, given one actuator per gas-exchange valve and two solenoid valves per actuator, eight solenoid valves are needed for each cylinder. Thus, in the case of a four-cylinder internal combustion engine, 32 solenoid valves result, which must be electrically driven.

For the electrical driving of the solenoid valves, German Published Patent Application No. 40 24 496 describes applying a pull-up voltage to a solenoid valve in a pull-up phase and to apply a lower holding voltage in a subsequent holding phase. So that the holding current in the holding phase does not exceed a specific limiting value, arranged in the holding-current circuit is a current sensing element which adjusts the level of the holding voltage as a function of the ascertained actual value of the holding current and a setpoint value of the holding current.

In addition to the actual current value detection, a current regulator is also necessary for each current control loop. This relatively high circuitry expenditure for regulating current would have to be provided for each individual solenoid valve of an electrohydraulic gas-exchange valve control. This would result in an enormously high circuitry expenditure for actuating an electrohydraulic gas-exchange valve control of an internal combustion engine.

It is therefore an object of the present invention to simplify the triggering of a solenoid valve without thereby impairing the performance reliability of the solenoid valve.

SUMMARY

To achieve this objective, the method for operating a solenoid valve according to the present invention provides that the solenoid valve is acted upon in a controlled manner in a cycle including three phases: in a pull-up phase, the solenoid valve is connected for a predefined time duration to a first voltage of predetermined magnitude for generating a pull-up current; in a holding phase, the solenoid valve is connected to a second voltage of predefined magnitude for generating a holding current; and in a de-energize phase, the solenoid valve is separated from both voltages.

In the pull-up phase, the armature of the solenoid valve may be pulled up as quickly as possible. This is achieved by a current overshoot. To that end, the magnetic coil of the solenoid valve is connected for a predefined time duration to the first voltage. The first voltage is considerably higher than, for example, a system voltage of a motor vehicle, e.g., than the voltage of the vehicle battery, for instance. Therefore, the operation of the solenoid valve during the pull-up phase with the high first voltage is a so-called boost operation. The high first voltage produces a particularly rapid buildup of the pull-up current in the magnetic coil. The time duration is selected so that the armature current necessary for rapidly and reliably pulling up the armature is reached.

During the holding phase, the pulled-up armature of the solenoid valve is retained by a reduced, constant holding current. Because of the magnetic-field characteristic, a considerably smaller force, and therefore a smaller current than for pulling up the armature is sufficient for holding the armature. During the holding phase, the magnetic coil of the solenoid valve is connected to the second voltage of predefined magnitude. The second voltage has a lower magnitude than the first voltage. The supply of the electromagnet by the second voltage ensures a constant holding current through the magnetic coil (regardless of fluctuations in the voltage of the vehicle electrical system).

In the de-energize phase, the electromagnet of the solenoid valve is separated from both voltages. As a result, after a decay phase, no current flows any longer through the electromagnet, and the armature returns to its starting position. During the decay phase, the current may be allowed to decay in different ways (e.g., diode extinction, Zener diode extinction, R-C extinction). In addition, the energy decayed during the decay phase may be recovered in various manners.

The method of the present invention does not provide a closed-loop control, but merely an open-loop control of the current of the solenoid valve. The current of the solenoid valve results by applying a voltage of predefined magnitude to the solenoid valve, because of the resistance of the magnetic coil of the solenoid valve. This holds true both in the pull-up phase and in the holding phase of the solenoid valve.

According to the present invention, it is possible to dispense with a current measurement, directly via a current-measuring element or indirectly via a voltage divider, which is formed by a measuring resistance and the resistance of the magnetic coil of the solenoid valve, and to dispense with a closed-loop current control by a current regulator. The operation of the solenoid valve is thereby simplified. In a simple manner, the method according to the present invention permits exact triggering of all solenoid valves of an electrohydraulic gas-exchange valve control of an internal combustion engine. A closed-loop current control for each of the solenoid valves is replaced in the method according to the present invention by an exact triggering as a function of time, at precisely defined supply voltages.

A voltage correction may be used to compensate for the effects of relevant changes in the branch circuits on the current flowing through the magnetic coils. Relevant changes in the branch circuits are, for example, the change of the coil resistance of the magnetic coil of a solenoid valve because of temperature changes in the magnetic coil. However, such a temperature compensation does not represent a closed-loop current control, but merely an adaptive open-loop current control.

In the method according to the present invention, the solenoid valve is not triggered in a clocked manner as in current regulation. The switching power loss and the high-frequency radiation of electromagnetic waves may be reduced by avoiding the clocking, thereby yielding a considerably better electromagnetic compatibility (EMC).

The first voltage may be derived by voltage boost from a vehicle system voltage and stabilized. For example, the vehicle system voltage corresponds to the voltage of a motor-vehicle battery. A voltage transformer, such as a DC/DC converter, may be used for the voltage boost.

The second voltage may be derived by voltage reduction or voltage boost from a vehicle system voltage and stabilized. The potential of the second voltage is below the potential of the first voltage. The voltage reduction and the voltage boost, respectively, may also be performed, for example, by a voltage transformer, particularly a DC/DC converter.

A 42 volt voltage, which is available in a 42 volt electrical system of a motor vehicle, may be used for the first voltage, and a lower voltage, particularly a 12 volt voltage or a 9 volt voltage which is available in the 42 volt vehicle electrical system, may be utilized as the second voltage. This embodiment relates to a 42 volt vehicle electrical system in which a lower voltage, particularly a 12 volt voltage or a 9 volt voltage, is usually also available which may be utilized directly as a second voltage. Thus, it is possible to dispense with a voltage reduction of a vehicle system voltage for generating the second voltage. Because of this, less power loss develops, and a lower heat generation of an output stage for actuating the solenoid valve results.

The voltages may be varied so that the resulting current during the pull-up phase and/or the resulting current during the holding phase is constant over all operating points. Both voltages, or just one of the two voltages, may be varied. In this manner, for example, it is possible to compensate voltage changes on the basis of temperature fluctuations.

The temperature of the magnetic coil of the solenoid valve may be detected, and the voltages may be adapted to the temperature sensitivity of the resistance of the magnetic coil. For this temperature compensation, the temperature of the magnetic coils may be detected at a representative location. To simplify the configuration of an electrohydraulic gas-exchange valve control of an internal combustion engine, it is possible to detect the temperature only at one solenoid valve or at a few selected solenoid valves. The temperature compensation permits an adaptive current control.

Alternatively, the current flowing through one representative magnetic coil of the solenoid valve is detected. In response to deviations from a desired current characteristic, the voltages are adapted accordingly. The current may be detected in any manner desired. A multitude of possibilities are conventional for that purpose.

The solenoid valve in the pull-up phase may be connected to the first voltage by the closing of two switching elements. A series connection of the switching elements provides a safety function for the solenoid valve. Only when both switching elements are closed may the solenoid valve pull up, because only then is the high first voltage for the pull-up operation applied to the solenoid valve. This arrangement prevents a solenoid valve from being unintentionally activated during a critical point of time because of a defective switching element (permanently closed) or in response to a faulty triggering of a switching element. For example, the moments during which the cylinder piston is at the top may be a critical time for an opening gas-exchange valve. Opening of the gas-exchange valve during this critical time may lead to a collision of the gas-exchange valve with the cylinder piston. This, in the same manner as a collision of one gas-exchange valve with another gas-exchange valve of the same cylinder, may lead to damage of the internal combustion engine.

To achieve the objective of the present invention, a circuit system includes a first voltage of pre-definable magnitude, a second voltage of pre-definable magnitude and two switching elements for applying the first voltage to the solenoid valve in the pull-up phase, for applying the second voltage to the solenoid valve in the holding phase and for separating the solenoid valve from both voltages in the de-energize phase.

By dispensing with a closed-loop current control in the circuit system according to the present invention, a considerable reduction in circuitry complexity and costs may be attained by using the open-loop current control. The expenditure for the central provision of the two voltages is lower than the expenditure for current regulation for each solenoid valve to be actuated. In addition, the small number of components in the circuit system of the present invention may reduce the probability of malfunction.

The circuit system may include a voltage boost chopper for deriving the first voltage from a vehicle system voltage and for stabilizing the first voltage. The circuit system may include a voltage buck chopper or a voltage boost chopper for deriving the second voltage from a vehicle system voltage and for stabilizing the second voltage. The voltage boost chopper and the voltage buck chopper are configured, for example, as DC/DC converters. Therefore, the circuit system according to the present invention has two central and independent DC/DC converters with stable fixed voltage for supplying the magnetic coil of the solenoid valve during the pull-up phase and during the holding phase.

The circuit system may include a 42 volt voltage source, which is available in a 42 volt electrical system of a motor vehicle, for generating the first voltage, and a further voltage source, particularly a 12 volt voltage source or a 9 volt voltage source which is available in the 42 volt vehicle electrical system, for generating the second voltage. In addition to a 42 volt voltage source, usually a further voltage source, particularly a 12 volt voltage source or a 9 volt voltage source, is available in a 42 volt vehicle electrical system, as well. The voltage of the further voltage source may be utilized directly as the second voltage. Thus, it is possible to dispense with the use of a voltage buck chopper for generating the second voltage. Because of this, less power loss develops, and a lower heat generation of an output stage for actuating the solenoid valve results.

A first connecting terminal of the solenoid valve may be connected via the first switching element to the first voltage, and via a first diode to the second voltage. A second connecting terminal of the solenoid valve may be connected, via an arrangement for the current decay and for the energy recovery, to the first voltage, and via the second switching element to ground. The arrangement for the current decay and for the energy recovery may be configured in any manner desired. The arrangement for the current decay and for the energy recovery may include a second diode. The first voltage is decoupled from the second voltage by the first diode. The second diode is used for the current decay in the magnetic coil of the solenoid valve, and simultaneously for the energy recovery after the magnetic coil has been separated from both voltages.

Alternatively, a first connecting terminal of the solenoid valve may be connected via the first switching element to the first voltage, and via the second switching element and a diode to the second voltage, and a second connecting terminal of the solenoid valve may be connected to ground.

DETAILED DESCRIPTION

Figure 4:
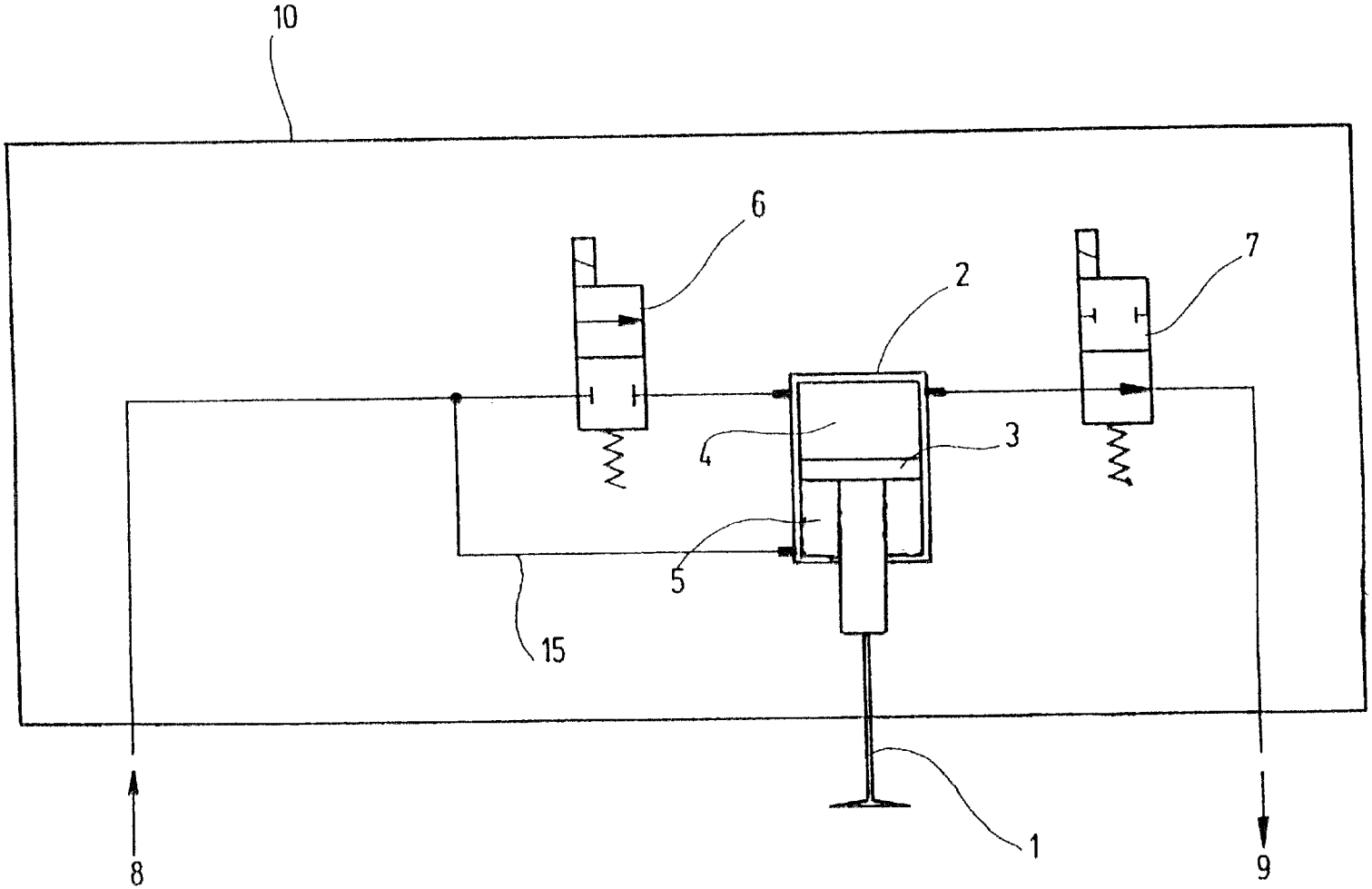
FIG. 4 illustrates an actuator of an electrohydraulically controlled gas-exchange valve of an internal combustion engine, having two solenoid valves which are driven according to the method of the present invention.

As illustrated in FIG. 4, an actuator for an electrohydraulically operable gas-exchange valve 1 of an internal combustion engine is designated in its entirety by reference numeral 10.

The camshaft is omitted for driving the gas-exchange valves in the electrohydraulic valve control. Each gas-exchange valve 1 has a separate actuator 10 for the opening and closing. Actuator 10 includes a control element 2 in which a hydraulic differential piston 3 is movably supported. Differential piston 3 divides the interior of control element 2 into an upper chamber 4 and a lower chamber 5. Given equal pressure in upper chamber 4 and lower chamber 5, the area difference between the upper side and the lower side of differential piston 3 results in a movement of differential piston 3 in control element 2, and to the opening of gas-exchange valve 1.

Oil is fed with a high pressure from a supply side 8 to actuator 10 and is directed via a first solenoid valve 6 into first chamber 4 of control element 2. The oil gets from first chamber 4 via a second solenoid valve 7 into a tank 9. Branching off from supply side 8 is a further line 15 which leads into second chamber 5 of control element 2, and via which oil from supply side 8 arrives with a high pressure in second chamber 5.

Electrohydraulically operated gas-exchange valve 1 is driven in three phases:

In a first phase, gas-exchange valve 1 executes an opening movement. To that end, second solenoid valve 7 is closed to prevent the oil from flowing out of upper chamber 4 toward tank 9. By opening first solenoid valve 6, oil is directed from supply side 8 with high pressure into upper chamber 4 of control element 2. Because of the larger area at the upper side compared to the lower side of differential piston 3, a resulting downwardly directed force at differential piston 3 is produced which results in an opening movement of gas-exchange valve 1.

In a second phase, gas-exchange valve 1, opened with full or partial stroke (determined by the opening duration of the first solenoid valve), is held statically open. To that end, with second solenoid valve 7 continuing to be closed, first solenoid valve 6 is also closed. Thus, during this phase, both solenoid valves 6, 7, i.e., the inlet and the outlet of upper chamber 4, are closed.

During a third phase, gas-exchange valve 1 executes a closing movement. For that purpose, first solenoid valve 6 is retained closed, and second solenoid valve 7 is opened, so that the oil from upper chamber 4 can discharge. Because of the oil pressure in lower chamber 5, a closing force acts on the lower side of differential piston 3, which is thereby moved upwardly and gas-exchange valve 1 is closed.

In an electrohydraulic gas-exchange valve control, each gas-exchange valve 1 includes a separate actuator 10 for the opening and closing. In the case of an internal combustion engine with 4-valve engineering, each cylinder includes two intake valves and two exhaust valves for the gas exchange. Therefore, eight solenoid valves 6, 7 are needed for each cylinder of the internal combustion engine. Accordingly, 32 solenoid valves, which must be electrically driven, are needed for an electrohydraulic gas-exchange valve control of a 4-cylinder internal combustion engine.

To simplify the driving of solenoid valves, particularly solenoid valves 6, 7 for operating an electrohdraulic gas-exchange valve control of an internal combustion engine, the present invention provides that solenoid valve 6, 7 are driven in a cycle including three phases. A pull-up phase is used for generating a pull-up current. During the pull-up phase, solenoid valve 6, 7 is connected for a predefined time duration to a first voltage U_1 of a predetermined magnitude. A holding phase is used for generating a holding current which is smaller than the pull-up current. During the holding phase, solenoid valve 6, 7 is connected to a second lower voltage U_2 of predetermined magnitude. During a de-energize phase, solenoid valve 6, 7 is seperated from both voltages U_1, U_2.

According to the present invention, the current flowing through the magnetic coil of solenoid valve 6, 7 is thus not controlled in closed-loop but rather is controlled in open loop. The current flowing through the magnetic coil adjusts itself as a function of the resistance of the magnetic coil, and of the applied voltage U_1, U_2.

Figure 1:
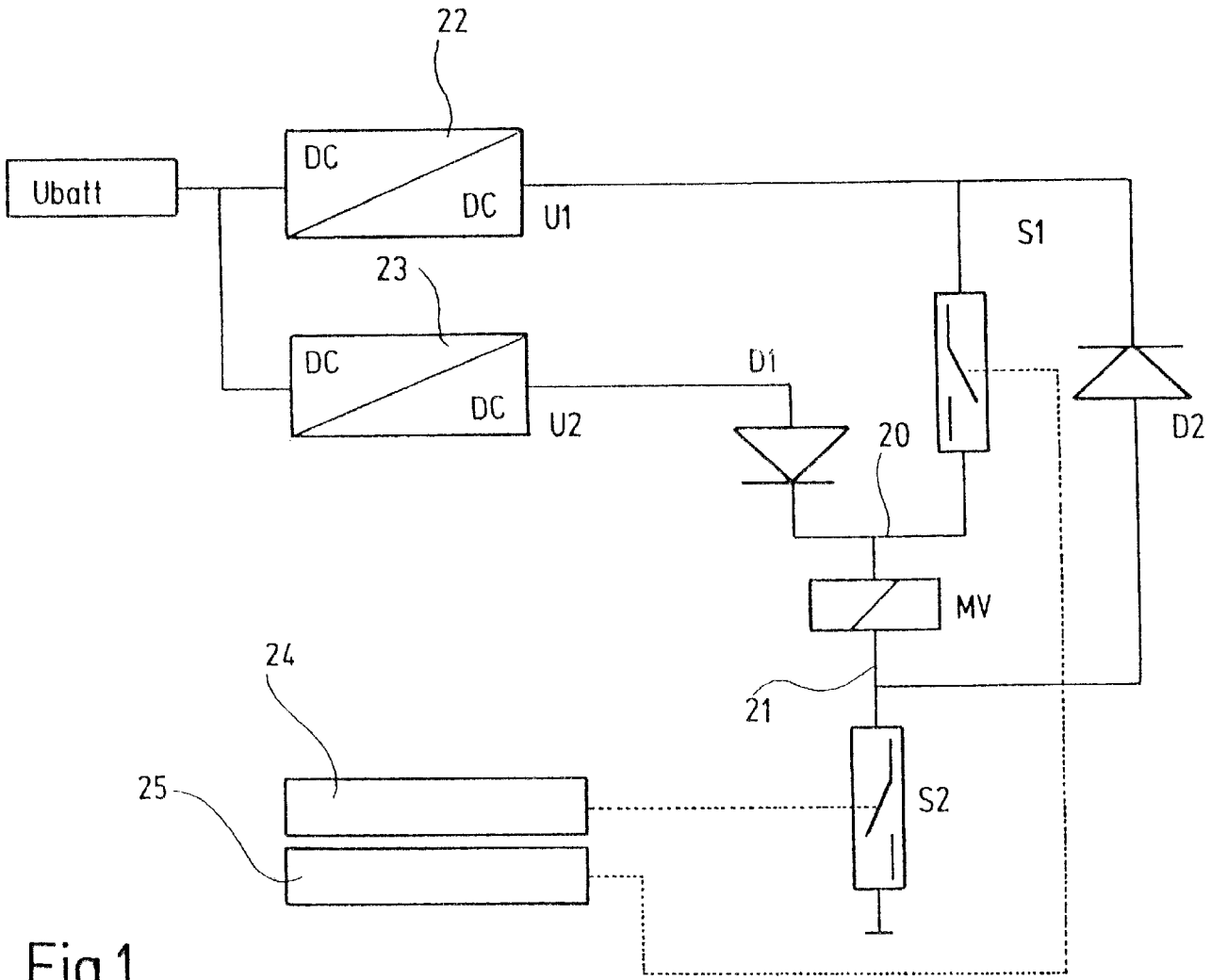
FIG. 1 illustrates a first example embodiment of a circuit system according to the present invention for operating a solenoid valve.

FIG. 1 illustrates a circuit system of the present invention according to a first example embodiment. The solenoid valve to be driven is designated by reference symbol MV. Solenoid valve to MV is, for example, a solenoid valve 6, 7 of an electrohydraulic gas-exchange valve control (see FIG. 4), an injection valve, or an intake or exhaust valve of an internal combustion engine. A first connecting terminal 20 of solenoid valve MV is connected via a first switching element S_1 to first voltage U_1 and via a first diode D_1 to second voltage U_2. First diode D_1 is used for decoupling first voltage U_1 from second voltage U_2. A second connecting terminal 21 of solenoid valve MV is connected via a second diode D_2 to first voltage U_1, and via a second switching element S_2 to ground. Second diode D_2 is used for the current decay in solenoid valve MV and for the energy recovery during the transition from the first phase to the second phase, after solenoid valve MV has been separated from both voltages U_1, U_2. Instead of second diode D_2, any other arrangement may be used for the current decay and for the energy recovery (e.g. Zener diode, R-C circuit). It is also possible that, instead of as illustrated in FIG. 1, second diode D_2 be arranged in parallel to solenoid valve MV.

First voltage U_1 is derived from a vehicle system voltage U_batt by a voltage boost chopper, configured as DC/DC converter 22, and stabilized. Second voltage U_2 is derived from vehicle system voltage U_batt by a voltage buck chopper or voltage boost chopper, configured as DC/DC converter 23, and stabilized. Second voltage U_2 is lower than first voltage U_1. First switching element S_1 and second switching element S_2 are driven by drive circuits 24, 25 (dotted line).

In the pull-up phase of solenoid valve MV, the magnetic coil is connected to voltage source U_1 by closing switching elements S_1, S_2 for a predefined time duration T_1. Time duration T_1 is determined such that the pull-up current is reached necessary for rapidly and reliably pulling up the armature of solenoid valve MV.

During the transition into the holding phase, switching elements S_1, S_2 are opened. The current is then allowed to decay again via second diode D_2 (diode freewheeling) until the holding-current level is reached. At this point of time (beginning of the second phase), second switching element S_2 is then closed again. Second voltage U_2 thereby takes over the supply of the magnetic coil of solenoid valve MV and ensures a constant holding current. Diode D_1 is necessary in order to avoid a short-circuit of first voltage U_1 to second voltage U_2 when first switching element S_1 is closed.

During the de-energize phase, with first switching element S_1 open, second switching element S_2 is also opened. The result is a rapid current decay by current recovery via second diode D_2 to first voltage U_1 (high potential). Because of the current recovery via second diode D_2, the circuit system of the present invention permits a particularly energy-conserving operation of solenoid valve MV.

In addition, the circuit system illustrated FIG. 1 provides a considerable gain in safety compared to conventional circuit systems for operating a solenoid valve. Namely, solenoid valve MV can only pull up when both switching elements S_1 and S_2 are closed. For example, an incorrect, unwanted pull-up of solenoid valve MV may also permit gas-exchange valve 1 to open at moments in which the piston of the cylinder of the internal combustion engine is in its top dead center. This may lead to a collision between gas-exchange valve 1 and the piston, which may result in damage to the internal combustion engine. The same is true for a collision between two gas-exchange valves of the same cylinder of the internal combustion engine.

Figure 2:
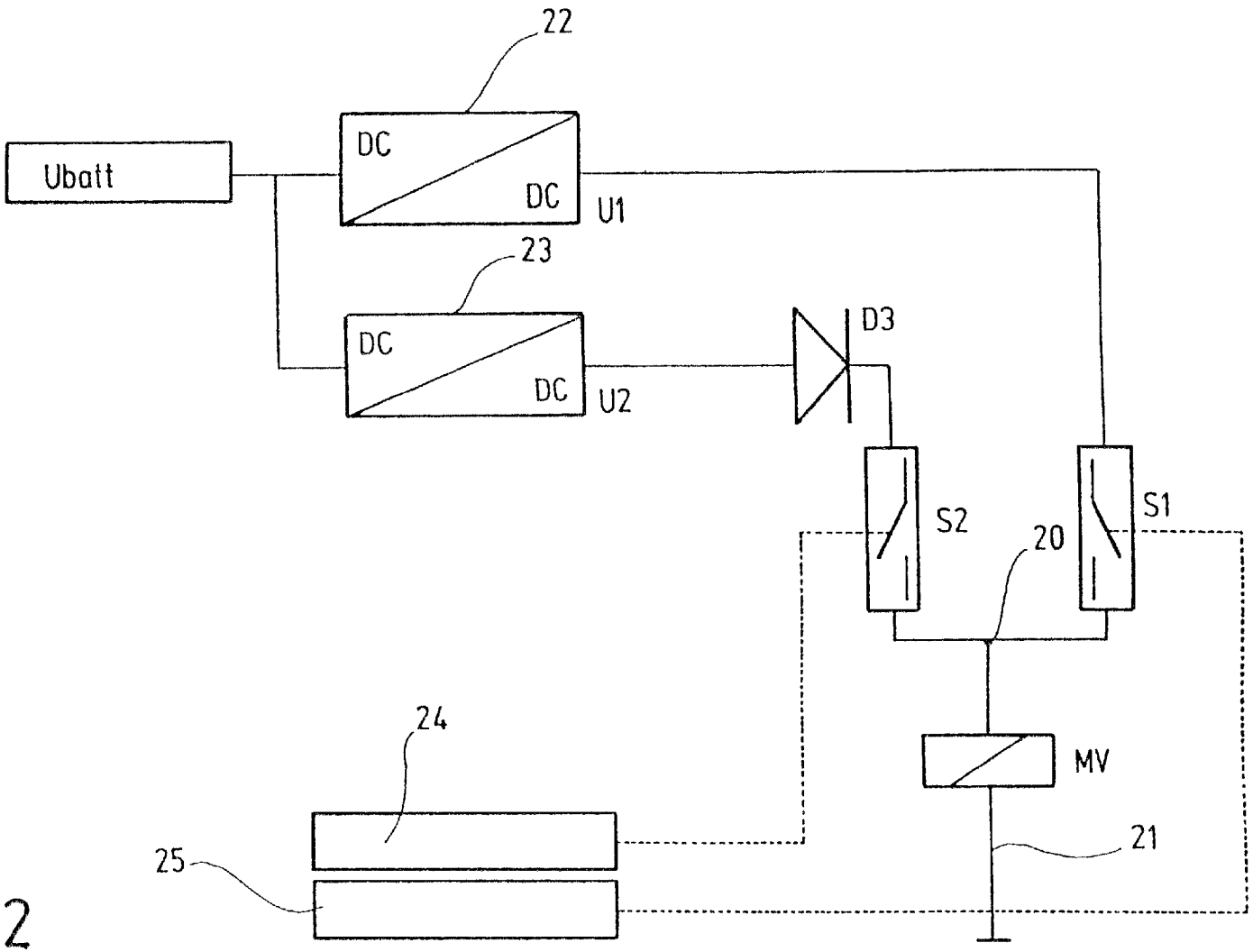
FIG. 2 illustrates a second example embodiment of a circuit system according to the present invention for operating a solenoid valve.

FIG. 2 illustrates a circuit system of the present invention according to a second example embodiment. First connecting terminal 20 of solenoid valve MV is connected via first switching element S_1 to first voltage U_1 and via second switching element S_2 and a diode D_3 to second voltage U_2. Diode D_3 is arranged to decouple first voltage U_1 from second voltage U_2. Second connecting terminal 21 of solenoid valve MV is connected to ground. Although not illustrated in FIG. 2, a suitable arrangement for the current decay and the energy recovery may be provided in this circuit system as well, for example, in the form of a further diode, which is arranged in parallel to solenoid valve MV.

In the pull-up phase, the armature of solenoid valve MV is pulled up by closing first switching element S_1. During the transition into the holding phase, first switching element S_1 is opened. After the current has dropped to the holding value, second switching element S_2 is closed. Second voltage U_2 thereby takes over the supply of solenoid valve MV. During the de-energize phase, second switching element S_2 is opened. In this example embodiment, current only flows through first switching element S_1 in the pull-up phase. Current does not flow through second switching element S_2 during this time, and therefore it also has no electrical power loss.

Figure 3:
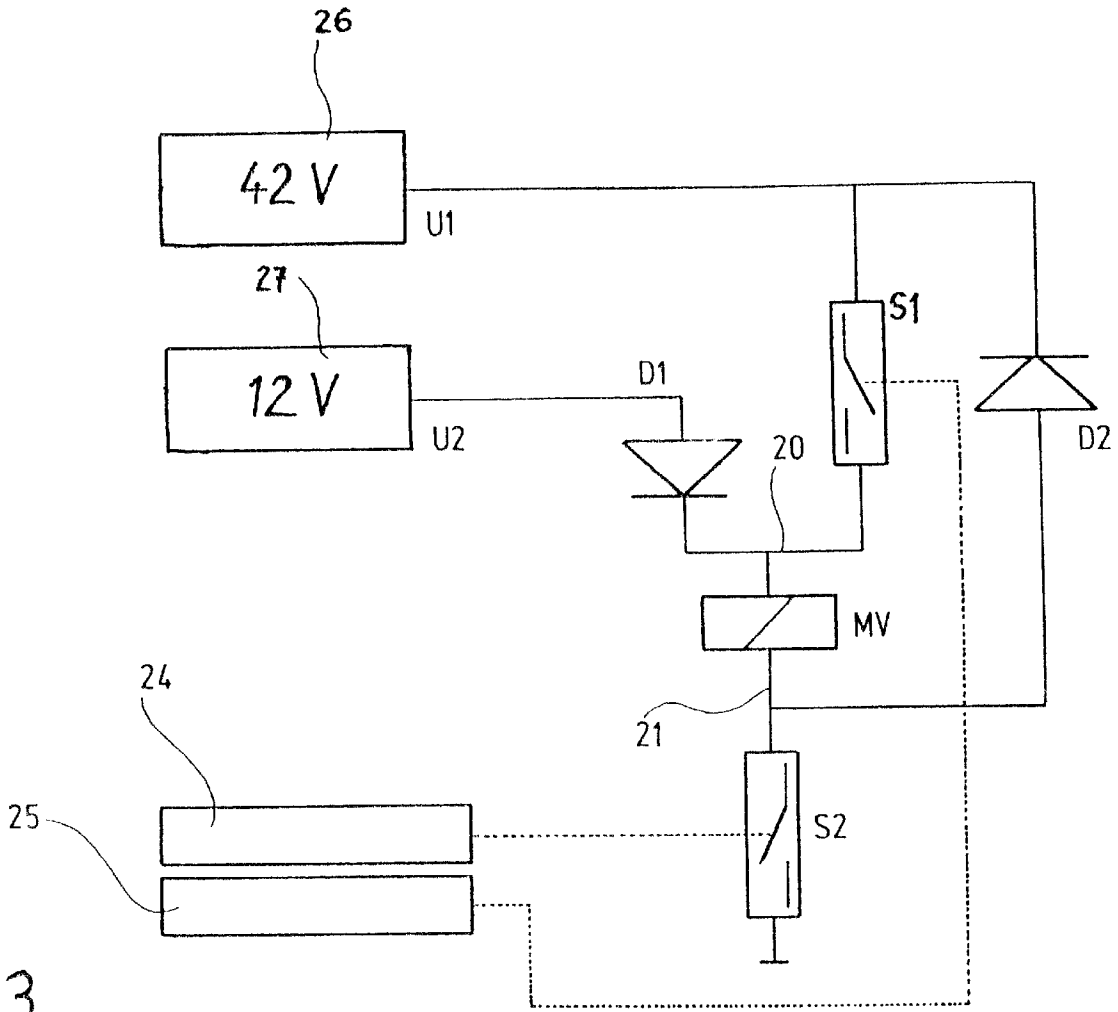
FIG. 3 illustrates a third example embodiment of a circuit system according to the present invention for operating a solenoid valve.

FIG. 3 illustrates a circuit system of the present invention according to a third example embodiment. This circuit system differs from that illustrated in FIG. 1 in that it dispenses with the use of a voltage boost chopper 22 or a voltage buck chopper 23 for deriving first voltage U_1 and second voltage U_2 from vehicle system voltage U_batt. In the circuit system illustrated in FIG. 3, switching elements S_1 and S_2 may also be arranged as illustrated in FIG. 2, instead of as illustrated in FIG. 1.

The circuit system illustrated in FIG. 3 starts from a 42 volt electrical system of a motor vehicle. The 42 volt vehicle electrical system includes a 42 volt voltage source 26 and a further voltage source 27 configured as a 12 volt voltage source. Instead of the 12 volt voltage source, a 9 volt or any other voltage source may also be provided. The 42 volt voltage is utilized for the energy supply of powerful assistance systems (x-by-wire systems) in the motor vehicle. Motor-vehicle systems having lower power consumption are supplied with energy by the further voltage source.

The 42 volt voltage of 42 volt voltage source 26 is utilized as first voltage U_1, and the 12 volt voltage of further voltage source 27 is utilized as second voltage U_2. The 42 volt voltage is applied to solenoid valve MV during the pull-up phase, and the 12 volt voltage is applied during the holding phase. At the end of the holding phase, the 12 volt voltage is then disconnected. With the aid of switching elements S_1 and S_2, a switchover is made from the 42 volt voltage to the 12 volt voltage, and the 12 volt voltage is then disconnected. Both the 42 volt circuit and the 12 volt circuit may be optimized with respect to dynamic response and power loss.

Solenoid valve MV may also be driven via a discharge capacitor, which is charged via a voltage source U_batt, 26 or 27, is separated from voltage source U_batt, 26 or 27 in accordance with a drive signal, and then supplies solenoid valve MV with energy in a discharge curve. At the beginning of the driving during the pull-up phase, the discharge capacitor supplies a relatively high voltage, e.g., a 42 volt voltage. During the holding phase, the capacitor voltage has then dropped and has reached, for example, 12 volts or 9 volts. The solenoid valve is then driven during the holding phase by this lower voltage.

To compensate for the temperature sensitivity of the coil resistance of the magnetic coil of solenoid valve MV, the level of voltages U_1 and U_2 may be adapted to the coil temperature. To that end, the temperature of the magnetic coils may be detected at one representative location. This temperature compensation permits an adaptive control of the current flowing through the magnetic coil to a constant value during the pull-up phase and during the holding phase, respectively. Alternatively, the current flowing through the magnetic coil of solenoid valve MV may be detected, and voltages U_1 and U_2 may be adapted to the current characteristic.

What is claimed is:

1. A method for operating a solenoid valve, comprising the steps of:

acting on the solenoid valve in a controlled manner in a cycle that includes three phases, the three phases including a pull-up phase, a holding phase and a de-energize phase;

in the pull-up phase, connecting the solenoid valve for a predefined time duration to a first voltage of predetermined magnitude to generate a pull-up current;

in the holding phase, connecting the solenoid valve to a second voltage of predetermined magnitude to generate a holding current; and in the de-energize phase, separating the solenoid valve from the first voltage and the second voltage;

wherein the first and second voltages are varied so that the pull-up current and the holding current remain substantially constant.

2. The method according to claim 1, wherein the solenoid valve is configured to actuate one of an electrohydraulic gas-exchange valve control, an injection valve, an intake valve and an exhaust valve of an internal combustion engine.

3. The method according to claim 1, further comprising the steps of:

deriving the first voltage from a vehicle system voltage by a voltage boost; and stabilizing the first voltage.

4. The method according to claim 1, further comprising the steps of:

deriving the second voltage from a vehicle system voltage by one of a voltage reduction and a voltage boost; and stabilizing the second voltage.

5. The method according to claim 1, further comprising the steps of:

utilizing a 42-volt voltage for the first voltage; and utilizing a lower voltage than the 42-volt voltage for the second voltage.

6. The method according to claim 5, wherein the lower voltage includes one of a 12-volt voltage and a 9-volt voltage.

7. The method according to claim 5, wherein the 42-volt voltage is provided in a 42-volt electrical system of a motor vehicle and the lower voltage is provided in the 42-volt electrical system.

8. The method according to claim 1, further comprising the steps of:

detecting a temperature of a magnetic coil of the solenoid valve; and adapting the first and second voltages to a temperature sensitivity of a resistance of the magnetic coil.

9. The method according to claim 1, further comprising the steps of:

detecting a current flow through a magnetic coil of the solenoid valve; and adapting the first and second voltages in response to a deviation from a desired current characteristic.

10. The method according to claim 1, wherein, in the pull-up phase, the solenoid valve is connected to the first voltage by closing two switching elements.

11. A circuit system for operating a solenoid valve, comprising:

a first voltage of predefined magnitude;

a second voltage of predefined magnitude; and two switching elements configured to apply the first voltage to the solenoid valve in a pull-up phase, to apply the second voltage to the solenoid valve in a holding phase and to separate the solenoid valve from the first voltage and the second voltage in a de-energize phase, wherein the first and second voltages are varied so that a pull-up current in the pull-up phase and a holding current in the holding phase remain substantially constant.

12. The circuit system according to claim 11, wherein the solenoid valve is configured to actuate one of an electrohydraulic gas-exchange valve control, an injection valve, an intake valve and an exhaust valve of an internal combustion engine.

13. The circuit system according to claim 11, further comprising a voltage boost chopper configured to derive the first voltage from a vehicle system voltage and to stabilize the first voltage.

14. The circuit system according to claim 11, further comprising one of a voltage buck chopper and a voltage boost chopper configured to derive the second voltage from a vehicle system voltage and to stabilize the second voltage.

15. The circuit system according to claim 11, further comprising:

a 42-volt voltage source available in a 42-volt electrical system of a motor vehicle, the 42-volt voltage source configured to generate the first voltage; and a second voltage source available in the 42-volt electrical system, the second voltage source configured to generate the second voltage.

16. The circuit system according to claim 15, wherein the second voltage source includes one of a 12-volt voltage source and a 9-volt voltage source.

17. The circuit system according to claim 11, wherein a first connecting terminal of the solenoid valve is connected to the first voltage via a first switching element and is connected to the second voltage via a first diode; and wherein a second connecting terminal of the solenoid valve is connected to the first voltage via a current decay and energy recovery arrangement and is connected to ground via a second switching element.

18. The circuit system according to claim 17, wherein the current decay and energy recovery arrangement includes a second diode.

19. The circuit system according to claim 11, wherein a first connecting terminal of the solenoid valve is connected to the first voltage via a first switching element and is connected to the second voltage via a second switching element and a diode; and wherein a second connecting terminal of the solenoid valve is connected to ground.

* * * * *